US009777410B2

(12) United States Patent
Herrmann et al.

(10) Patent No.: US 9,777,410 B2
(45) Date of Patent: Oct. 3, 2017

(54) HEDDLE FOR A LOOM AND LOOM EQUIPPED WITH SUCH A HEDDLE

(71) Applicant: Staubli Lyon, Chassieu (FR)

(72) Inventors: Michel Herrmann, Fontaines sur Saone (FR); Philippe Gaubert, Chassieu (FR); Damien Bouchet, Chaponnay (FR)

(73) Assignee: STAUBLI LYON, Chassieu (FR)

( * ) Notice: Subject to any disclaimer, the term of this patent is extended or adjusted under 35 U.S.C. 154(b) by 2 days.

(21) Appl. No.: 14/876,916

(22) Filed: Oct. 7, 2015

(65) Prior Publication Data

US 2016/0108563 A1 Apr. 21, 2016

(30) Foreign Application Priority Data

Oct. 16, 2014 (FR) ..... 14 59961

(51) Int. Cl.

| | |
|---|---|
| ***D03C 9/02*** | (2006.01) |
| ***D03C 3/00*** | (2006.01) |
| ***D03C 9/06*** | (2006.01) |
| *D03C 9/00* | (2006.01) |

(52) U.S. Cl.

CPC ..... *D03C 9/024* (2013.01); *D03C 3/00* (2013.01); *D03C 9/02* (2013.01); *D03C 9/026* (2013.01); *D03C 9/0625* (2013.01)

(58) Field of Classification Search

CPC ..... D03C 9/02; D03C 9/024; D03C 9/026; D03C 3/40; D03C 3/44; D03C 3/42

See application file for complete search history.

(56) References Cited

U.S. PATENT DOCUMENTS

| | | | | |
|---|---|---|---|---|
| 2,267,558 A * | 12/1941 | Fernberg | F16B 21/086 16/86 A |
| 4,245,377 A * | 1/1981 | Soltes | A44C 5/2052 24/625 |
| 4,385,754 A * | 5/1983 | Waite | G05G 5/05 267/71 |
| 5,309,950 A * | 5/1994 | Bassi | D03C 3/40 139/85 |

(Continued)

FOREIGN PATENT DOCUMENTS

| | | |
|---|---|---|
| CN | 201228305 Y | 4/2009 |
| EP | 1908863 | 4/2004 |

OTHER PUBLICATIONS

French Search Report in related French Application No. 1459961, dated Mar. 6, 2015.

*Primary Examiner* — Bobby Muromoto, Jr.
(74) *Attorney, Agent, or Firm* — Dowell & Dowell, PC

(57) ABSTRACT

A heddle for guiding a warp yarn for a loom extends lengthwise along a longitudinal axis (X4) and is formed by an assembly of a heddle body including at least one strand, and an eye including an eyelet for the passage of a warp yarn, and defining a main plane (P) wherein a first part of the strand and the eye is provided, before assembly, with an end part a second part of the strand and the eye is provided, before assembly, with a cavity for receiving the end part arranged at a longitudinal end of the second part and wherein the receiving cavity is provided with a bottom and emerges on an outside of the second part, along a transverse axis (Z4) perpendicular to the main plane (P).

15 Claims, 11 Drawing Sheets

(56) References Cited

U.S. PATENT DOCUMENTS

| | | | | |
|---|---|---|---|---|
| 5,379,496 | A * | 1/1995 | Krauss | A44B 11/266 24/115 G |
| 5,819,809 | A * | 10/1998 | Bassi | D03C 3/40 139/85 |
| 7,025,094 | B2 * | 4/2006 | Vanderjeugt | D03C 3/44 139/59 |
| 7,036,532 | B2 * | 5/2006 | Bauder | D03C 3/44 139/52 |
| 2007/0084518 | A1 * | 4/2007 | Himmelstoss | D03C 9/02 139/11 |
| 2008/0083471 | A1 * | 4/2008 | Mettler | D03C 9/024 139/93 |

* cited by examiner

HEDDLE FOR A LOOM AND LOOM EQUIPPED WITH SUCH A HEDDLE

BACKGROUND OF THE INVENTION

Field of the Invention

The invention relates to a heddle for guiding a warp yarn for a loom, as well as a loom equipped with such a heddle.

Brief Description of the Related Art

A loom of the Jacquard type is equipped with a Jacquard mechanism to control several hooks. Each hook is most often associated with several arches. Each arch is connected to one end of a guide heddle for a warp yarn, which is connected by another end to the frame of the loom via a spring. Each heddle is provided with an eyelet for passage of the warp yarn and is made up of an eye and a heddle body including two strands. These parts can be manufactured separately. The heddle is then called composite and requires an engagement of the eyes and strands before the assembly of eyes and heddle bodies and before the placement of the heddle.

To that end, it is known from EP-A-1,989,346 to use an eye provided at both ends with a longitudinal hole and two strands, each provided with an end having a smaller section. The end of the strand with a smaller section is inserted into the longitudinal housing of the eye. The placement of the parts in one another for their assembly is delicate so as to avoid damaging the parts during the engagement of the strand in the eye. The eye/strand assembly next takes place "blind". In particular when gluing is chosen, it is impossible to verify the thickness of the glue seam and the proper distribution of the glue. Furthermore, the engagement in a longitudinal housing limits the residual sections of the eye around the longitudinal hole and the end sections of the strands.

Furthermore, CN-Y-201228305 discloses a heddle which, in the embodiment of FIGS. 4 to 6, comprises a porcelain eye provided with two housings and four cavities for receiving part of the strands of a smooth body overmolded around the eye. Each cavity comprises two side walls and a bottom in the transverse direction. The strands are formed during the overmolding and are therefore not designed to be engaged in the cavities. Furthermore, these cavities are positioned in pairs on each transverse side of the eye relative to a main plane of the eye such that, at the longitudinal level of the receiving cavity, each strand covers the eye by two inner opposite transverse sides of the strand, and each eye covers the strand by two outer opposite transverse sides of the eye. This arrangement causes a significant bulk of the eye/strand connection in the transverse direction. The overmolding may create burrs on the side faces of the strand when the mold closes around the eye during the injection of the plastic material. The heddles must be gone over again by polishing to eliminate the burrs that may destroy adjacent yarns when they rub on the heddle during weaving.

SUMMARY OF THE INVENTION

The invention more particularly aims to resolve these drawbacks by proposing a composite heddle having a strong resistance to forces and a limited bulk.

In that spirit, the invention relates to a heddle for guiding a warp yarn for a loom, the heddle extending lengthwise along a longitudinal axis and being formed by the assembly of a heddle body including at least one strand and an eye including an eyelet for the passage of the warp yarn, and defining a main plane. According to the invention, a first part among the strand and the eye is provided, before assembly, with an end part, the second part among the strand and the eye is provided, before assembly, with a cavity for receiving the end part arranged at one longitudinal end of that second part, and the receiving cavity is provided with a bottom and emerges on the outside of the second part along a transverse axis, perpendicular to the main plane.

Owing to the invention, the overlap of the eye and the strand at a cavity with a bottom and emerging in the transverse direction makes it possible to form an assembly in a minimal transverse bulk and to limit the bulk of the composite heddle in the loom, and therefore the impact of the heddle on the yarn density of the loom.

According to advantageous but optional aspects of the invention, such a guide heddle may incorporate one or more of the following features, considered in any technically allowable combination:

- At the longitudinal level of the receiving cavity, the first part overlaps the second part by a single transverse side of the first part.
- At a same level along the longitudinal axis, the depth of the receiving cavity is greater than or equal to the thickness of the part received in the cavity, those two properties being measured parallel to the transverse axis.
- The receiving cavity is delimited, along an axis that is perpendicular to the longitudinal and transverse axes, by at least one side wall, while each side wall has a rounded outer longitudinal rim and each side wall is beveled toward a free end of the second part.
- The receiving cavity has no side wall and the bottom of the receiving cavity is formed by a final portion with the free end of the second part.
- The bottom of the receiving cavity is delimited along the longitudinal axis by a beveled part toward the bottom of the cavity.
- The longitudinal end of the second part comprises another cavity, which extends the receiving cavity with no side wall, and in which a portion of the first part is received, the other cavity being defined by at least one side wall and a bottom along the transverse axis.
- The other cavity is defined by two side walls, a bottom and a ceiling.
- The cavity has a gradual reduction in width along the lateral axis, while the width of the free end of the part with cavity is smaller than the width of the part received in the cavity at the same longitudinal level, those widths being measured parallel to the lateral axis.
- The first part has a transition zone with a gradual reduction in width along the lateral axis positioned at the longitudinal level of the cavity.
- The part on which the cavity is arranged is made from a plastic material, preferably injected.
- The heddle comprises an eye and two strands, each strand being provided, at one end, with at least one cavity for receiving a part of the eye, and at the other end, means for connecting to an element of a Jacquard harness of the loom or a heald frame.
- At least one housing arranged on the bottom of the receiving cavity is positioned across from the housing arranged on the part of the first part to form a pair of housings, while a resin assembly member extends through the pair of housings in a direction transverse to the longitudinal axis to ensure assembly between the body and the eye.

An assembly between the body and the eye is done by clipping, gluing, welding, plastic crushing, screwing and/or riveting.

The invention also relates to a loom equipped with several guide heddles for a warp yarn. This loom is characterized in that at least one guide heddle is as mentioned above.

BRIEF DESCRIPTION OF THE DRAWINGS

The invention will be better understood and other advantages thereof will appear more clearly in light of the following description, provided solely as a non-limiting example and done in reference to the appended drawings, in which.

DESCRIPTION OF THE PREFERRED EMBODIMENTS

Figure 24:
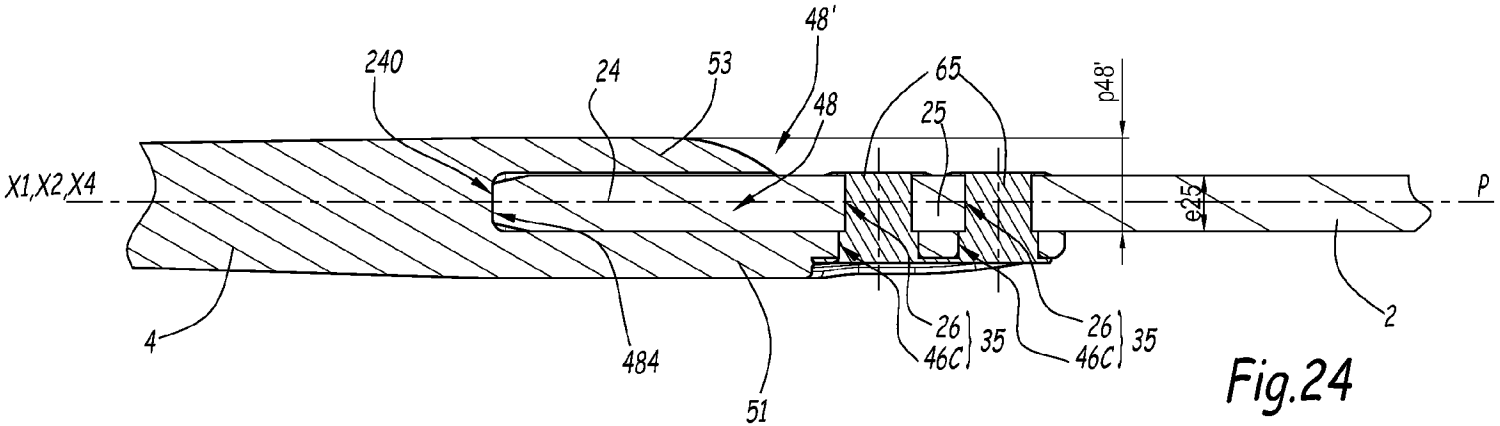

The Jacquard-type loom M shown in FIG. 24 is equipped with a Jacquard mechanism 102 that commands several hooks 104, a lower end of which is associated with several arches 106. A lower end 106*a* of each arch 106*a* is connected to an upper end 1*a* of a guide heddle 1 of a warp yarn, each heddle 1 being subject to the action of a return spring 108 fastened to a fastening beam 110 by a rod 112, the beam 110 being fastened on a frame of the loom M. The elements 106, 1, 108, 110 and 112 form a harness H of the loom M.

FIGS. 1 to 8 show a first embodiment of a guide heddle 1 of a warp yarn for a Jacquard-type loom.

The guide heddle 1 extends lengthwise along a longitudinal axis X1 and comprises a heddle body 10 and an eye 2. The heddle body 10 includes two separate strands 4. References Y1 and Z1 denote two axes of the heddle 1, perpendicular to the axis X1, the axis Y1 corresponding to the width of the eye 2, while the transverse axis Z1 corresponds to its thickness. The guide heddle is formed by the assembly of the heddle body 10 and the eye 2.

At each end, the heddle body 10 has connecting means 11A or 11B for connecting to an element of the harness H, specifically to a spring 108 or an arch 106. At a first end of the heddle body 10, the connecting means 11A comprise an outer thread 12 that is designed to be screwed in a spring 108. At a second end of the heddle body 10, the connecting means 11B are designed to connect to an arch 106 of the Jacquard harness H. The means 11B comprise an end-piece 14 that forms an opening 16 for passage and jamming of the arch 106 and a rigid connecting tube 18, made from plastic or metal. The connecting means 11B are according to EP-B-1,741,815. Alternatively, other connecting means can be provided at the ends of the heddle body 10.

Figure 1:
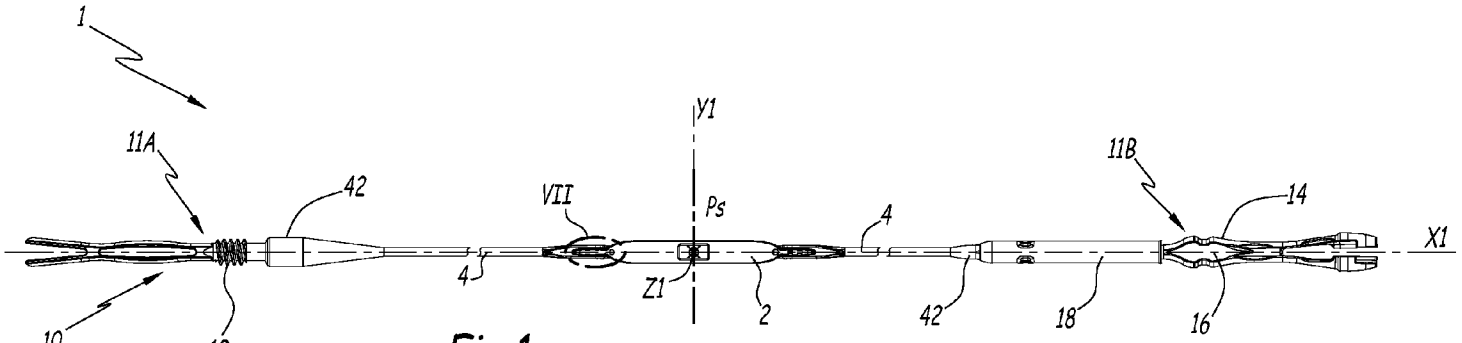
FIG. 1 is an elevation view of a guide heddle for a warp yarn for a loom of the Jacquard type according to a first embodiment of the invention.
Figure 2:
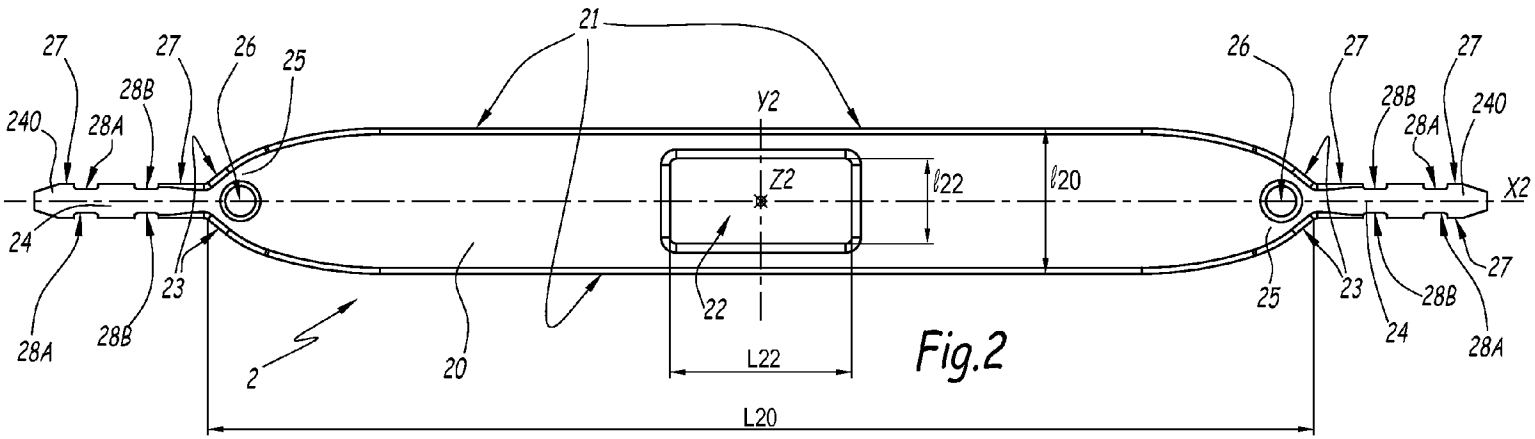
FIG. 2 is an enlarged view of an eye of the heddle of FIG. 1.
Figure 8:
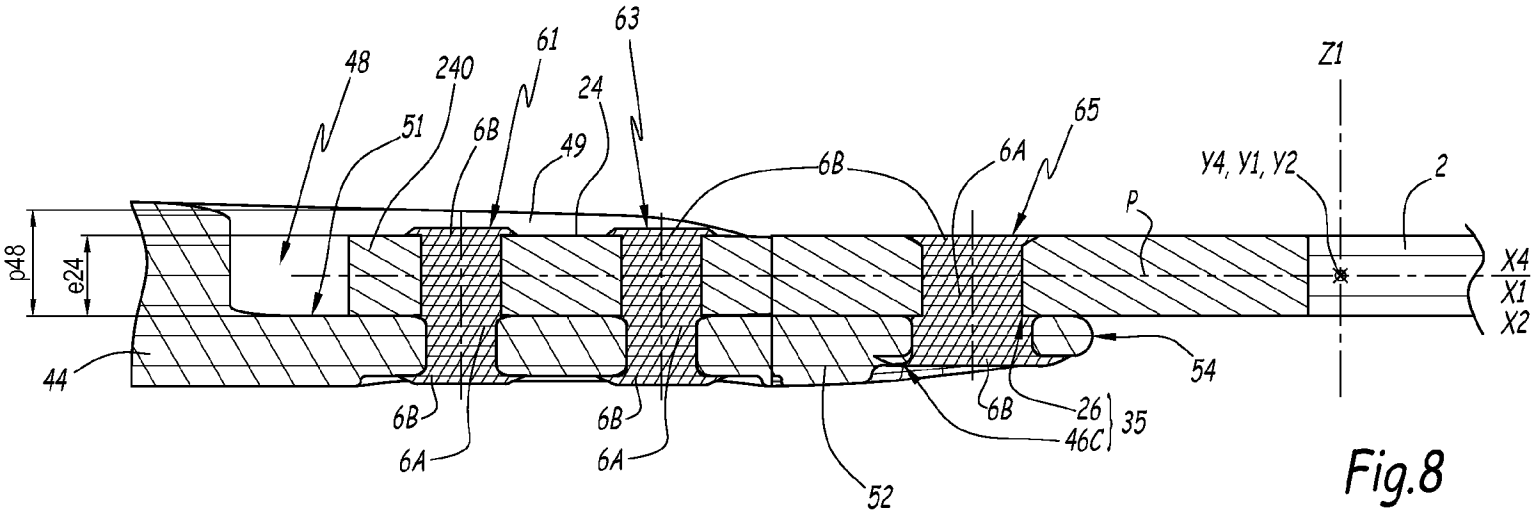
FIG. 8 is an enlarged partial sectional view, along plane VIII-VIII of FIG. 7, of an assembly zone between a strand and the eye.

The eye 2 is planar and extends lengthwise along a longitudinal axis X2. Reference Y2 denote a lateral axis, perpendicular to the axis X2. The eye 2 includes a central portion 20 that has lateral rims 21 rounded by polishing. The central portion 20 is provided with an orifice that forms an eyelet 22 for the passage of a warp yarn, said eyelet 22 crossing all the way through the eye 2 along a transverse axis Z2, perpendicular to the axes X2 and Y2. The axes X2, Y2 and Z2 are concurrent at the center of the eyelet 22. The eyelet 22 is rectangular in a mean plane P of the eye 2 that contains the axes X2 and Y2. The main plane P corresponds to the median plane of the two surfaces of the eye 2 with maximal area. FIGS. 1 and 2 are parallel to that main plane P, which is shown in FIG. 8.

In the assembled configuration of the heddle 1, the axes X2, Y2 and Z2 are respectively combined with the axes X1, Y1 and Z1 of the heddle 1.

The eye 2 is symmetrical relative to a plane of symmetry $P_S$ that contains the axes Y2 and Z2.

Reference L22 denotes the length of the eyelet 22 measured parallel to the longitudinal axis X2 and L20 denotes the length of the central portion 20 of the eye 2 measured parallel to the axis X2. This length L20 is greater than or equal to five times the length L22. Reference l22 denotes the width of the eyelet 22 measured parallel to the lateral axis Y2. Lastly, l20 denotes the width of the central portion 20 of the eye 2 measured parallel to the axis Y2. The width l22 of the eyelet 22 is greater than half of the width l20 of the central portion 20 of the eye 2 and is preferably equal to 60% of the width l20.

The central portion 20 of the eye 2 is extended, before assembly of the heddle 1, on each side along the longitudinal axis X2 by a tab 24. The tabs 24 have, along the axis Y2, a width l24 that is reduced relative to the central portion 20. Each tab 24 has a free longitudinal end 240 opposite the central part 20. The reduction in width along the axis Y2 is gradual, from the central portion 20 toward each tab 24. Each tab 24 forms a longitudinal end of the eye 2.

The main plane P of the eye corresponds to the main plane of the longitudinal ends 24 of the eye 2.

The central portion 20 has, near each tab 24, two rounded cams 23 that provide the junction between the part with width l20 of the central portion 20 and the adjacent tab 24. Reference 25 denotes a transition defined in the central portion 20 near a tab 24 and bordered by cams 23. Within the meaning of the present invention, the transition zone 25 forms an end part of the eye 2.

The eye 2 includes a housing 26 at each transition zone 25. The housings 26 are formed by holes crossing all the way through the eye 2 parallel to the axis Z2 and have a circular section in the main plane P. Alternatively, the housings or holes 26 have an oblong or polygonal section in the main plane P. The housings 26 are designed to receive resin.

Reference 27 denotes the longitudinal edges of a tab 24. Each edge 27 is provided with two notches 28A and 28B offset along the axis X2 and that form housings for receiving resin, as shown by the following explanations.

The notches 28A and 28B extend over the entire thickness of the tabs 24 in the direction of the axis Z and are in the form of rectangular indentations in the main plane P. According to one alternative, the notches 28A and 28B of the eye 2 are in the form of semicircular indentations in the main plane P. On each side of the eye 2, the housing 26 and the notches 28A and 28B are offset, along the longitudinal axis X2, relative to one another.

The eye 2 is made from single-thickness metal. The eye 2 is made by cutting a metal sheet and its rims 21 are polished, so as to have rounded shapes not aggressive for the yarns. Alternatively, the eye 2 is made from polyamide or ceramic.

Reference e24 denotes the thickness of the tabs 24, measured parallel to the axis Z2.

References X4, Y4 and Z4 respectively denote a longitudinal axis and two transverse axes of a strand 4. In the assembled configuration of the heddle 1, the axes X4, Y4 and Z4 are respectively combined with the axis X1, Y1 and Z1 of the heddle 1.

Each strand 4 comprises a rod 41 having a round section along a transverse plane $P_T$ perpendicular to the longitudinal axis X4 and parallel to the axes Y4 and Z4. The rod 41 extends lengthwise between a first longitudinal end 42, on which the connecting means 11A or 11B are arranged, and a second longitudinal end 44 at which the assembly is done with the eye 2. At the end 44, each strand 4 widens along the lateral axis Y4 and fins along the transverse axis Z4, moving away from the rod 41. In other words, each end 44 has a cross-section that flattens moving away from the rod 41.

At its flat end 44, before assembly of the heddle 1, each strand 4 has a single receiving cavity 48, arranged on a single transverse side of the strand 4, that receives a tab 24 of the eye 2. In the assembled configuration of the heddle 1, the free end 240 is received in the receiving cavity 48. In practice, the entire tab 24 is received in the cavity 48. The receiving cavity 48 emerges in the direction of the longitudinal axis X4 and in the direction of the transverse axis Z4. The receiving cavity 48 is laterally delimited in the direction of the axis Y4 by two side walls 49. The receiving cavity 48 includes a bottom 51 that delimits it along the transverse axis Z4. The receiving cavity 48 emerges on the outside of the strand 4 along the longitudinal axis X4, toward a free end 54 of the strand 4, opposite the end 42, and along the transverse axis Z4, perpendicular to the main plane P, opposite the bottom 51.

The side walls 49 are rounded, i.e., they have rounded outer longitudinal rims on their edge opposite the cavity 48.

Reference 482 denotes the end of the cavity 48 by which the cavity emerges to the outside, along the axis X4. Reference 484 denotes the end of the cavity 48 opposite the end 482, i.e., the closed end of the cavity 48. In a plane containing the axes X4 and Y4, the end 484 is semicircular and r48 denotes its inner radius.

The bottom 51 of the cavity 48 is extended, past the end 482 and in the direction of the longitudinal axis X4 toward the eye 2, by a final portion 52 that protrudes laterally from the side walls 49 and that itself has no such walls. The final portion 52 has a free end 54. The final portion 52 things toward the free end 54 widthwise along the lateral axis Y4 and also in terms of the thickness along the transverse axis Z4. In particular, the final portion 52 includes two edges 52A and 52B that converge toward the axis X4 as they come closer to the free end 54. Along the axis Z4, the final portion 52 is flush with the same level as the bottom 51. Thus, the receiving cavity 48 completely emerges on the outside of the strand 4 along the longitudinal axis X4.

The side walls 49 each extend by a beveled edge 50 toward the final portion 52, the beveled edges 50 producing the transition between the side walls 49 and the final portion 52. Each side wall 49 includes an inner surface 490 that has a rough and/or striated surface obtained directly during manufacturing of the strand 4.

As shown more particularly in FIG. 8, the eye 2 and the strand 4 overlap one another by the tab 24 and the transition zone 25 and by the bottom 51 and the final portion 52, respectively. Thus, the overlap between the parts 2 and 4 takes place on a single transverse side of each of these parts. In particular, at the longitudinal level of the cavity 48, i.e., along the longitudinal axis X4, the part 2 overlaps the part 4 by a single transverse side of the part 2.

Reference p48 denotes the depth of the receiving cavity 48 measured parallel to the transverse axis Z4 at the side walls 49. The depth p48 varies along the axis X4. In the assembled configuration of the heddle 1, at a same longitudinal level along the axis X1, the depth p48 is greater than the thickness e24, such that, when the tab 24 is received in the cavity 48 of the strand 4 with the tab 24 in contact with the bottom 51, the side walls 49 protrude past the tab 24 in a direction parallel to the axes Z2 and Z4. Thus, the cavity 48 limits the contact between the tab 24 received in the cavity 48 and the adjacent yarns of the heddle. Each cavity 48 is globally complementary to the tab 24 that it receives.

According to an alternative that is not shown, the depth p48 is equal to the thickness e24.

Figures 3, 4:
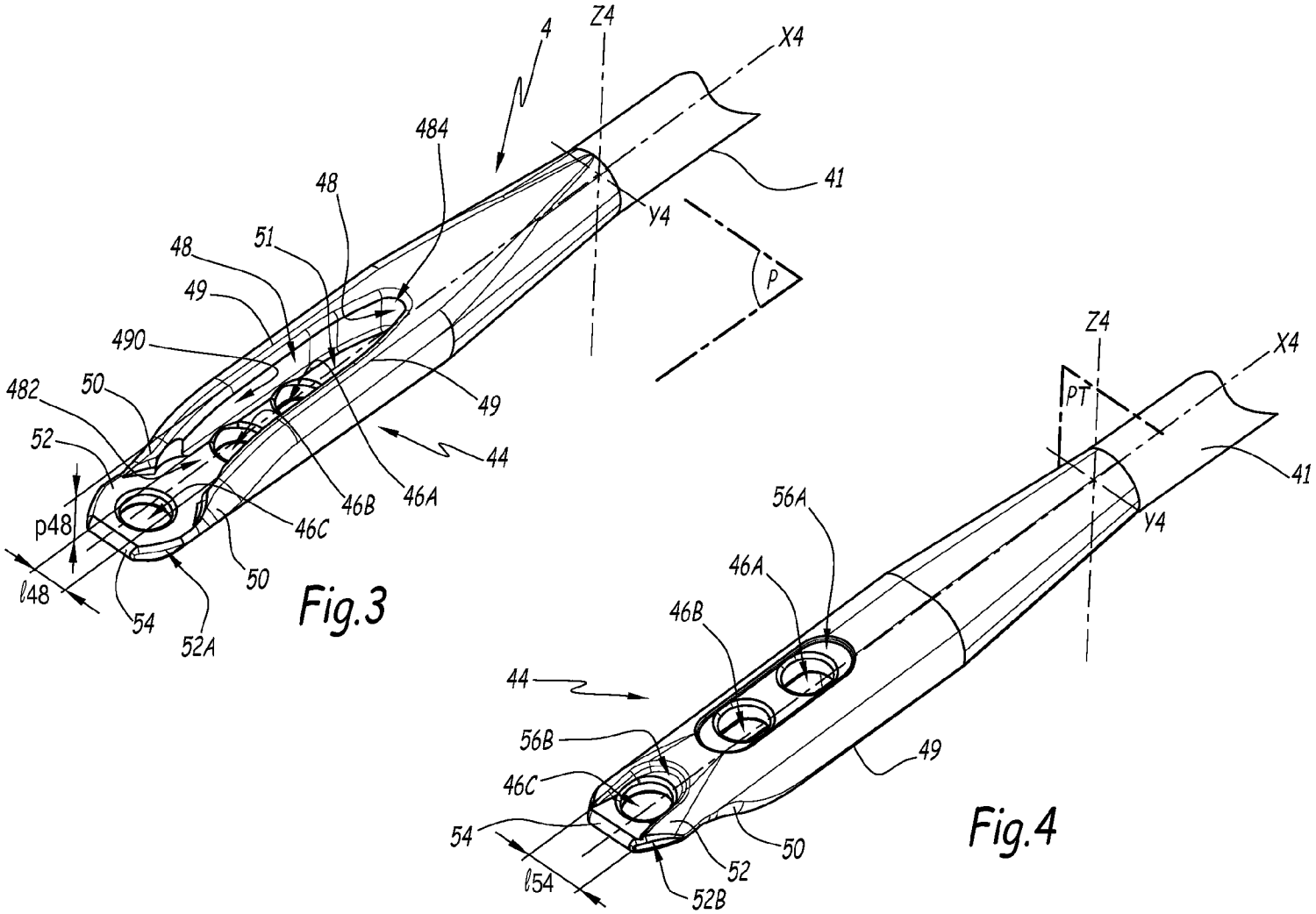
FIG. 3 is an enlarged perspective view of one end of a strand of the heddle of FIG. 1, a cavity being upwardly open in that figure.
FIG. 4 is a perspective view from another angle of the end of FIG. 3, the cavity facing downward in figure.
Figure 5:
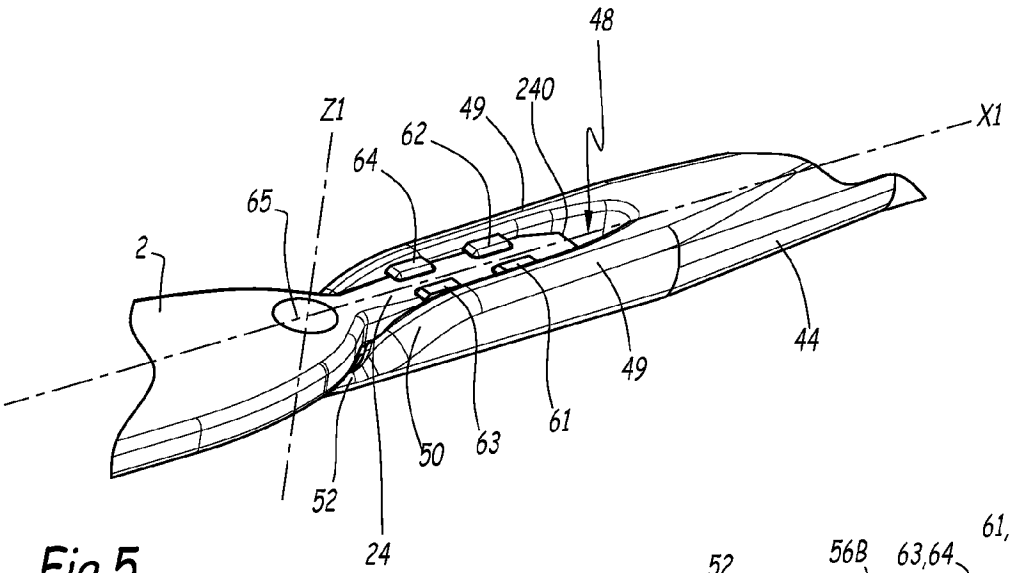
FIG. 5 is an enlarged partial perspective view of an assembly zone between a strand and the eye of the heddle in FIG. 1.
Figure 6:
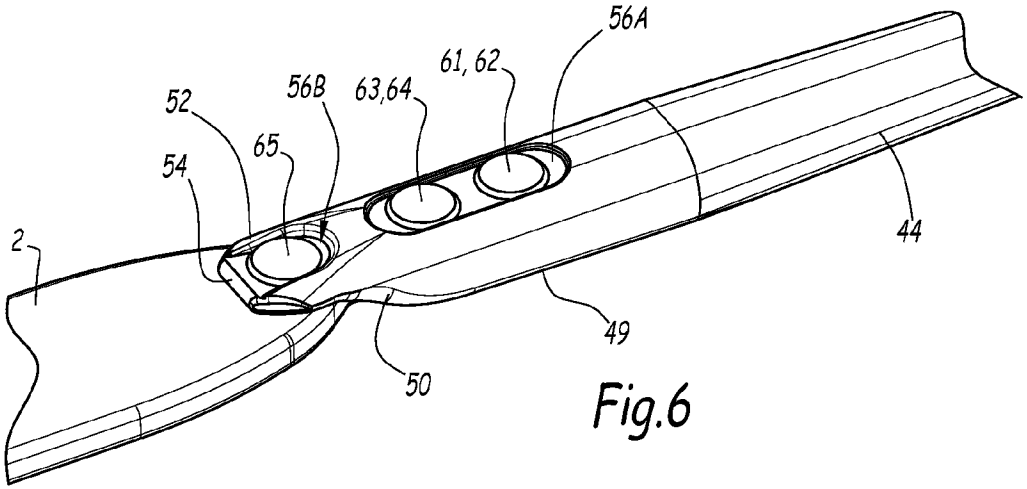
FIG. 6 is a view similar FIG. 5, from another angle.
Figure 7:
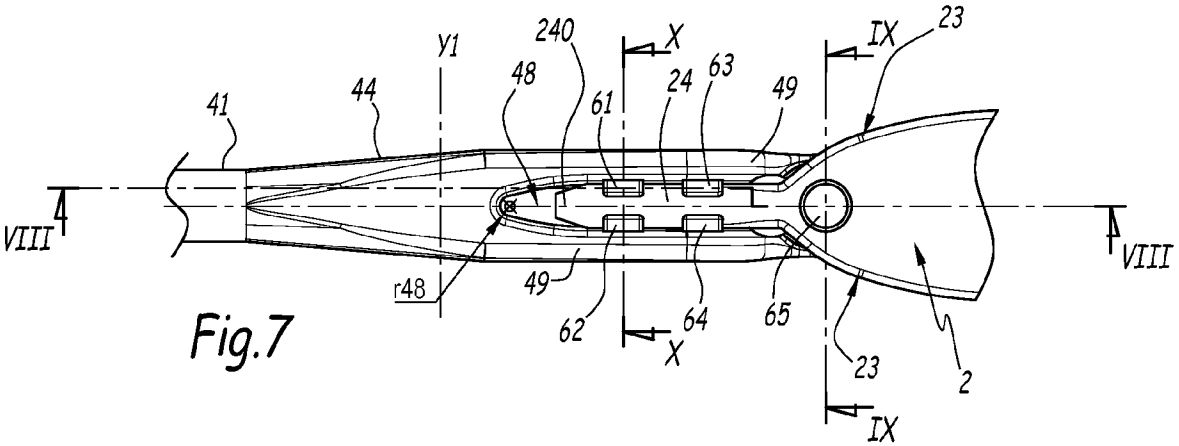
FIG. 7 is an enlarged view of detail VII in FIG. 1.

On the side of the end 44 opposite the receiving cavity 48, and as shown in FIG. 4, two longitudinal slots 56A and 56B are arranged.

Also arranged on the end 44 are three housings 46A, 46B and 46C, which are formed by holes crossing all the way through the end 44 parallel to the transverse axis Z4. The two housings 46A and 46B cross through the bottom 51 of the receiving cavity 48, while the housing 46C crosses through the final portion 52 of the strand 4. The three housings 46A, 46B and 46C are offset along the longitudinal axis X4. On the side of the end 44 opposite the receiving cavity 48, the two housings 46A and 46B emerge in the longitudinal slot 56A and the housing 46C emerges in the longitudinal slot 56B.

Each housing 46A, 46B and 46C has a circular section.

Alternatively, the housings 46A, 46B and 46C are holes having an oblong or polygonal section.

Reference l48 denotes the width of the cavity 48 measured parallel to the axis Y4, between the side walls 49. The cavity 48 has gradual variations in width l48 along the axis X4. The radius r48 is smaller than half of the maximum width l48, preferably between 20 and 40% of the maximum width l48, which creates a gradual reduction in width of the cavity 48 to reinforce the lifetime of the part with the cavity.

The strand 4 is made from polyamide and is manufactured by injection.

Advantageously, the strand 4 is reinforced with fibers, for example glass or carbon fibers. The outer thread 12 and end-piece 14 of the connecting means 11A and 11B are obtained directly during the injection of the strands and therefore form a single piece with the rods 41.

In the mounted configuration of the heddle, i.e., when the eye 2 is assembled to each strand 4 by engagement of the tabs 24 in the cavities 48, the transition zone 25 of the eye 2 is positioned longitudinally overlapping the final portion 52, such that, at the transition between the eye 2 and each strand 4, the central portion 20 of the eye 2 and the strand 4 overlap one another. The transition between the eye 2 and each strand 4 does not occur abruptly at the ends 240 and 44 of the second parts but, on the contrary, takes place when the eye 2 and the strand 4 are overlapping.

Reference l54 denotes the width of the free end 54 of the final portion 52 measured parallel to the lateral axis Y4. Additionally, reference l23 denotes the width of the eye 2 between the rounded cams 23, that width l23 being measured parallel to the axis Y2 and along the axis X2 at the same longitudinal level as the free end 54 when the heddle is assembled. The width l54 is smaller than the width l23. This geometry limits the risks of catching of these yarns rubbing against the heddle 1.

The eye 2 and each strand 4 respectively overlap in the longitudinal direction X1, such that the housings 46A and 46B are respectively across from the axis Z1, with the notches 28A and 28B and such that the housing 46C is across from the axis Z1 with the housing 26. The housings 26, 28A and 28B of the eye 2 and housings 46A, 46B and 46C of the strand 4 then form five pairs of housings.

Figure 11:
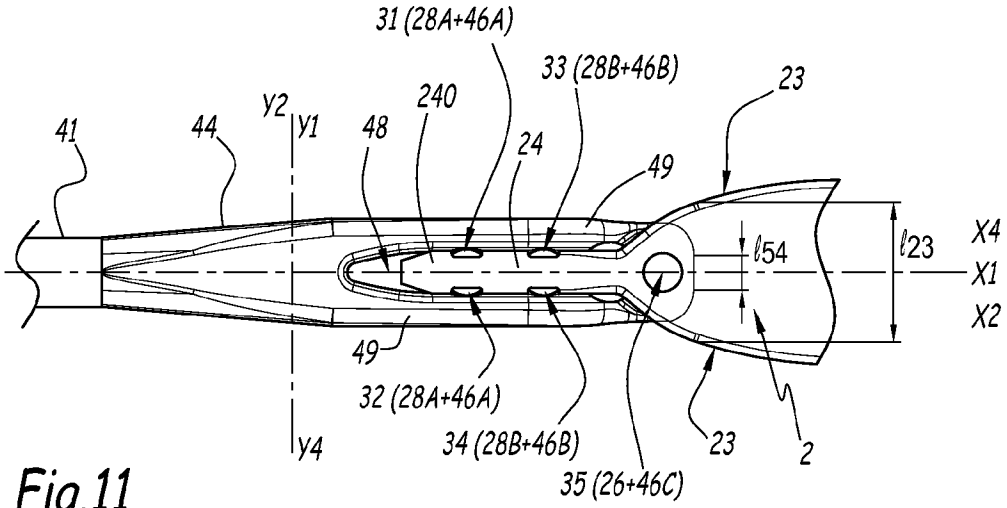
FIG. 11 is a view similar to FIG. 7 before the resin is deposited at the interface between the eye and the strand.
Figure 12:
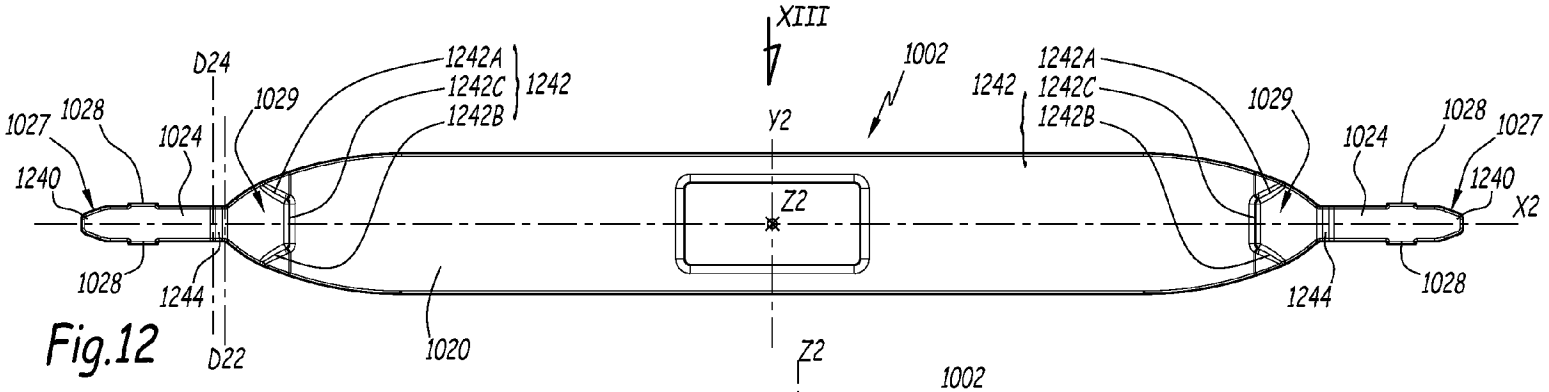
FIG. 12 is an elevation view of an eye belonging to a heddle according to a second embodiment of the invention.

At each tab 24, these five pairs of housings are identified with references 31, 32, 33, 34 and 35 in FIG. 11. The pair of housings 31 is formed by the housing 46A and the notch 28A situated above the axis X1 in that figure, and which is closest to the free end 240. The pair of housings 32 is formed by the housing 46A and by the notch 28A situated below the axis X1 in that figure and which is closer to the free end 240. The pairs 33 and 34 are respectively formed by the housing 46B and the notches 28B respectively positioned above and below the axis X1 and that are furthest from the free end 240. The pair 35 is formed by the housings 46C and 26.

During manufacturing of the heddle 1, the eye 2 provided with its two tabs 24 is engaged with the strand 4 provided with its two receiving cavities 48. Specifically, the two strands 4 are placed on a horizontal planar bearing surface, the cavities 48 being open on top, i.e., emerging on the same side along the axis Z1. The strand 4, which is designed to be connected to an arch, is provided with a connecting tube 18 prior to the assembly with the eye 2. The eye 2 is next placed on the two strands 4, with its tabs 24 engaged in each of the cavities 48, in contact with the bottoms 51 of the cavities 48.

A controlled quantity of epoxide resin is then deposited in each pair of housings 31 to 35. Alternatively, the resin is an acrylic resin. This resin is deposited in each pair of housings when it is still liquid and spreads under the effect of gravity such that it fills each pair of housings. The excess resin is distributed in the slots 56A and 56B and in the receiving cavity 48. Lastly, the resin is hardened by heating under a temperature that depends on its composition. Alternatively, the resin hardens at ambient temperature or under ultraviolet or LED radiation. The resin solidifies in the pairs of housings. The solidified resin then forms assembly members 61, 62, 63, 64 and 65 in the form of rivets that each extend through the eye and the strand along the transverse axis Z1.

The resin is therefore deposited in a cavity 48 in each housing 26, 28A, 28B of the eye 2 from the top of the heddle and spreads under the effect of gravity and by capillarity until it reaches the housings 46A, 46B, 46C of the strand 4 and in the slots 56A and 56B.

For i comprised between 1 and 5, each assembly member 6i has no clearance in a pair of housings 3i. Each rivet 6i includes a body 6A that is situated at the pair of housings 3i. Each rivet 6i also includes a head 6B, on each side of the pair of housings 3i. The heads 6B are formed by excess resin that overflows on the end 44 in the slots 56A and 56B and on the tab 24 received in the receiving cavity 48.

Figure 10:
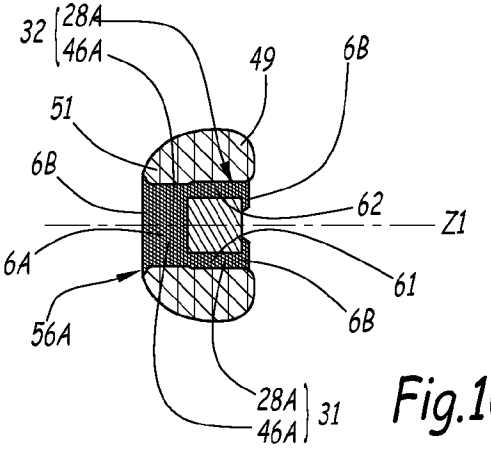
FIG. 10 is an enlarged sectional view along plane X-X in FIG. 7.
Figure 9:
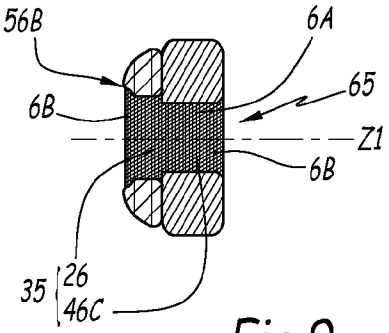
FIG. 9 is an enlarged sectional view along plane IX-IX in FIG. 7.

As more particularly shown in FIG. 10 and inasmuch as the housing 46A is shared by the pairs of housings 31 and 32, the rivets 61 and 62 form a single piece. The same is true for the housing 46B, the pairs 33 and 34 and the rivets 63 and 64.

These rivets 6i ensure an assembly between the final end 44 of each strand 4 and the corresponding tab 24 of the eye 2. The assembly rivets 6i act as obstacles positioned between the strand 4 and the eye 2 and prevent the relative movement between the eye 2 and the strand 4 in both directions along the longitudinal axis X1 as well as in both directions of the lateral axis Y1. The heads 6B of the rivets 6i prevent the eye 2 and the strand 4 from separating in the transverse direction Z1. The rivets 6i block the relative movement of the eye 2 and strand 4 around the axis X1, the axis Y1 and the axis Z1.

The rivets 6i do not bias the eye 2 or the strands 4 when they are placed and during hardening of the resin. Furthermore, when the resin is deposited, it may extend between several pairs of housings, parallel to the longitudinal axis X1 and lateral axis Y1. The resin then forms bridges that connect the heads 6B of some of the rivets 6i to one another. In that case, the mechanical blocking force is improved.

In that respect, the slots 56A and 56B can, alternatively, be communicating to allow the creation of a bridge between the rivets 63 and 64 on the one hand, and 65 on the other hand.

The assembly members 6i, in particular the rivet bodies 6A, the rivet heads 6B and any bridges, remain contained in the inner volume of the receiving cavity 48 and in the volume of the slots 56A and 56B on the opposite side. The cavity 48 and the slots 56A and 56B then protect the adjacent yarns from rubbing with the rivets 6i.

Since the housings receiving the resin cross through the eye 2 and the strands 4 in the direction of the transverse axis Z1, it is possible to inspect the proper placement of the eye 2 relative to each strand 4 and also the proper placement of the resin in the pairs of housings 3i for the formation of homogenous rivets 6i with controlled sections.

Owing to the receiving cavity 48 emerging in a direction perpendicular to the main plane P, it is possible to limit the bulk of the heddle in the directions Y1 and Z1 and therefore to limit the impact of the heddle on the yarn density of the loom.

According to an alternative that is not shown in the figures, the receiving cavity 48 is arranged in the eye 2 and the end 44 of the strand 4 has a reduced width received in that cavity 48. The strand 4 and the eye 2 overlap and form the pairs of housings 3i.

FIGS. 12 to 17 show a second embodiment of a guide heddle 1001 for a warp yarn of a loom of the Jacquard type. The elements of the second embodiment bear the same references as those of the first embodiment increased by 1000. Hereinafter, we will not provide a detailed description of the elements of the second embodiment that are similar to those of the first embodiment.

In the second embodiment, the steel eye 1002 is symmetrical relative to the plane of symmetry $P_S$; it includes a central portion 1020 and two tabs 1024. A main plane P of the eye 1002 corresponds to the median plane of the two surfaces 1020A and 1020B of maximum area. Each tab 1024 forms a longitudinal end of the eye 1002 and has, in the direction of the transverse axis Z1, a reduced thickness toward its free end 1240. This reduction is obtained by localized crushing of the eye 1002, which is shown by the transitional part 1242.

Reference e20 denotes the thickness of the central portion 1020 of the eye 2 measured parallel to the transverse axis Z1, and reference e24 denotes the thickness of a tab 1024 of the eye 1002 measured parallel to the transverse axis Z1, past the transition part 1242 relative to the central portion 1020. The thickness e24 is smaller than the thickness e20. The transition part 1242 is V-shaped with a flat bottom with two sides 1242A and 1242B and a central bottom 1242C.

Each tab 1024 also has a cambered part 1244. The transition part 1242 and the cambered part 1244 together define a niche 1029. The cambered part 1244 is positioned longitudinally along the axis X1 between the niche 1029 and the free end 1240 of the eye 1002.

Reference 1027 denotes the longitudinal edges of each tab 1024. Each edge 1027 has a projection 1028 protruding, relative to the edge 1027, along the direction of the lateral axis Y1. The projections 1028 are positioned longitudinally between the cambered part 1244 and the free end 1240 of the eye 1002.

Reference 1246 denotes an intermediate portion of the tab 1024 defined, along the axis X1, between the parts 1242 and 1244. The cambered part 1244 is respectively deviated in an inclined manner, relative to the intermediate part 1246 and a planar portion that defines the free end 1240, at the longitudinal level of two straight lines D22 and D24 parallel to the axis Y1.

Figure 13:
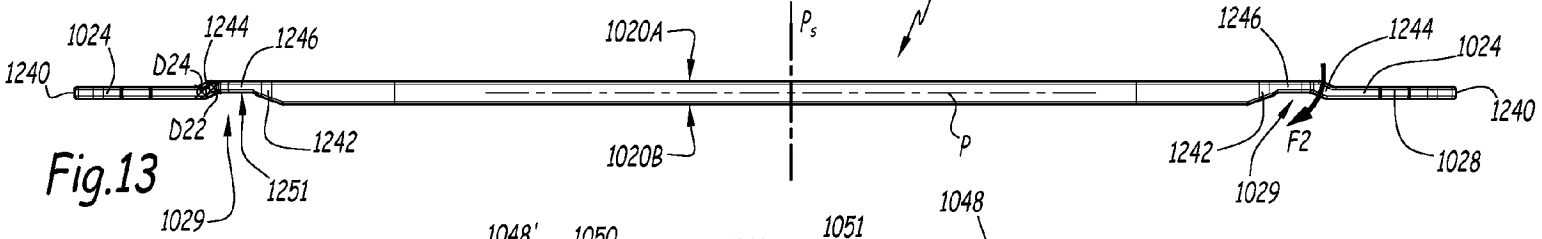
FIG. 13 is a side view along arrow XIII of the eye of FIG. 12.

Thus, the part 1242 is cambered transversely to the mean plane P, as shown by arrow F2 in FIG. 13.

The heddle body 1010 includes two separate strands 1004. Each strand 1004 includes, at its end 1044, a receiving cavity 1048, arranged on a single transverse side of the strand 1004, emerging on the outside of the strand 1004 along the transverse axis Z1 perpendicular to the main plane P of the eye. The cavity 1048 has a bottom 1051 that delimits it along the transverse axis Z1 in which a through housing 1046 emerges. In particular, the housing 1046 makes it possible to form two lateral notches 1049A on the inside of the side walls 1049 of the cavity 48. The final portion 1052 of each strand 1004 ends with a free end 1054. The final portion 1052 is raised relative to the bottom 1051. It limits the outlet of the cavity 1048 along the axis X1.

Figure 14:
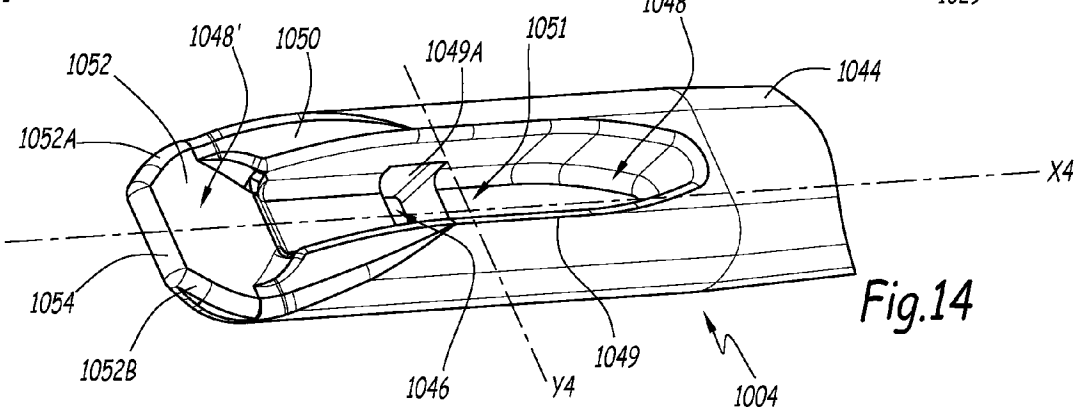
FIG. 14 is an enlarged perspective view of one end of a strand of the heddle according to the second embodiment of the invention, a cavity being upwardly open in that figure.
Figure 15:
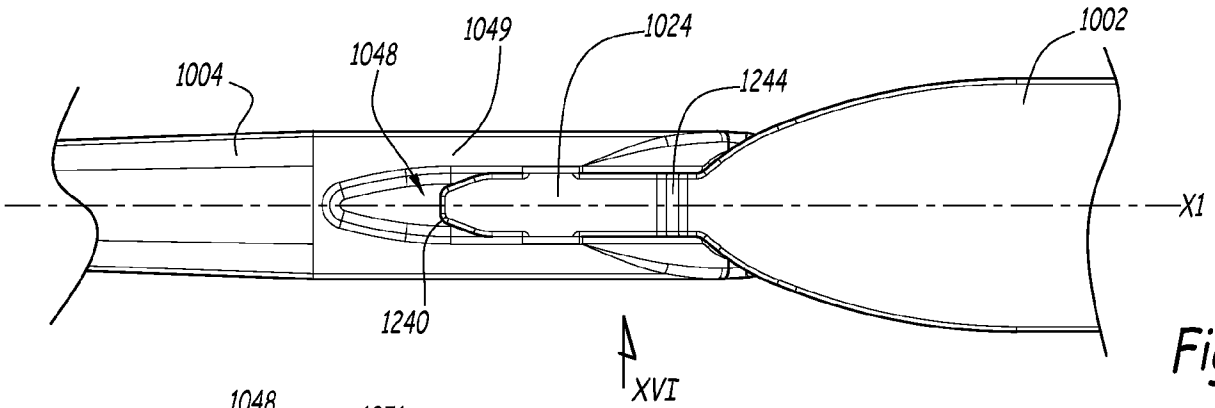
FIG. 15 is an elevation view of an assembly zone between the strand and the eye.

Furthermore, a distal cavity 1048' is arranged across from the portion 1052, on a single transverse side of the strand 1004, the cavity 1048' being defined by the dihedron formed by the face of the final portion 1052 visible in FIG. 14 and the half-plane of the beveled edges 1050 of the walls 1049 that join that face, on either side of the mouth of the cavity 1048. The bottom of the distal cavity 1048' in the transverse direction Z1 is formed by the final portion 1052. The cavity 1048' has no side wall, i.e., it is not delimited by physical walls along the lateral axis Y1.

In the assembled configuration of the heddle 1001, each tab 1024, with its free end 1240, is received in the receiving cavity 1048 arranged on each strand 1004 and the distal cavity 1048' receives the intermediate portion 1246 of the tab 1024.

The receiving cavity 1048 of the two strands of the heddle 1001 emerge on the same side along the axis Z1. Furthermore, each final portion 1052, with its free end 1054, is received in the niche 1029 of the eye 1002. The niche 1029 therefore also constitutes a receiving cavity for the longitudinal end of the strand 1004 formed by the final portion 1052. The bottom 1251 of that cavity 1029 is formed by the face of the intermediate portion 1246 turned toward the transition part 1242. The edges 1242A and 1242B of the transition part 1242 cooperate with reduced lateral clearance with the edges 1052A and 1052B of the final portion 1052 and thus constitute side walls for the niche or cavity 1029.

Figure 16:
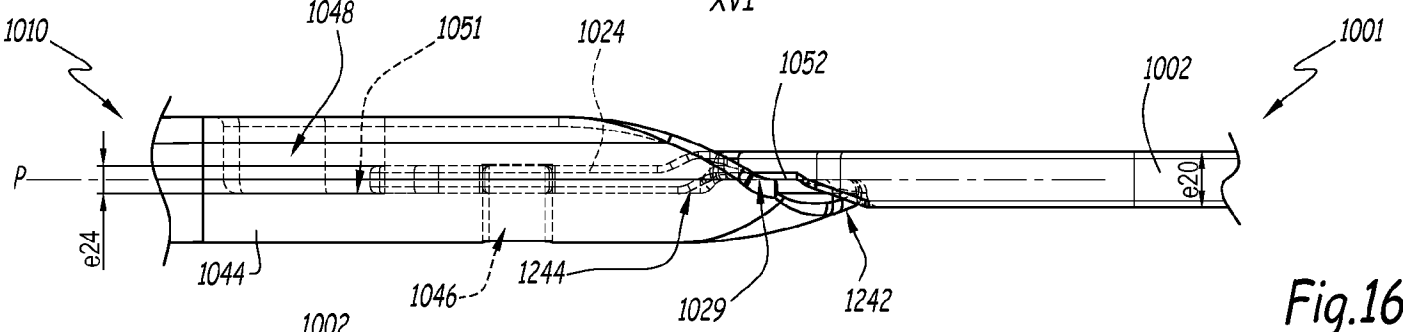
FIG. 16 is a side view along arrow XVI of the assembly zone of FIG. 15.
Figure 17:
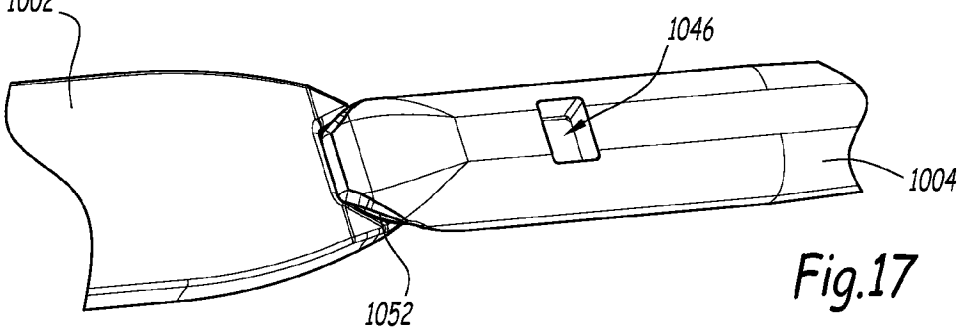
FIG. 17 is a perspective view of the assembly zone of FIGS. 15 and 16, the cavity of the strand being turned downward in that figure.
Figure 18:
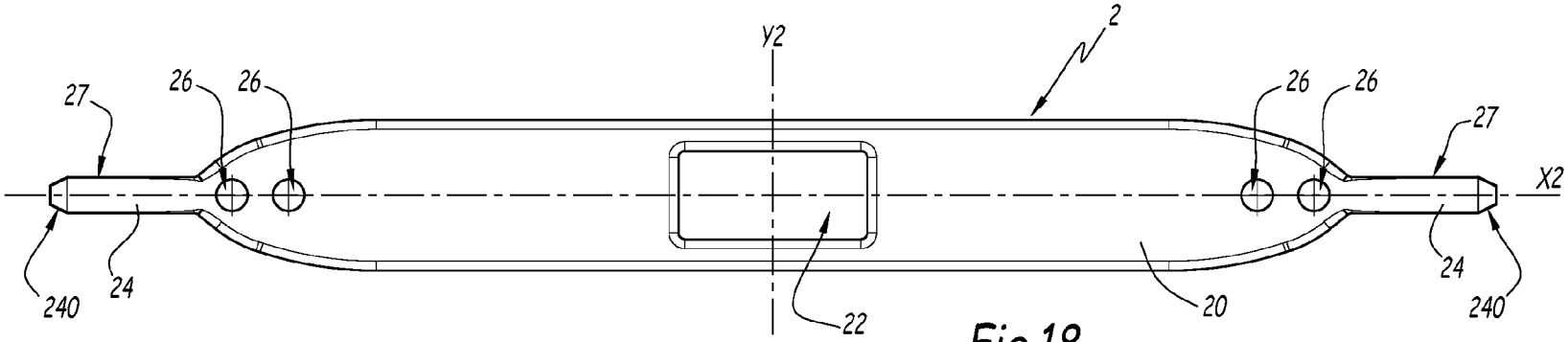
FIGS. 18 to 24 are views similar to FIGS. 2 to 8, respectively, some of which are on a smaller scale, for a guide heddle according to a third embodiment of the invention.
Figure 20:
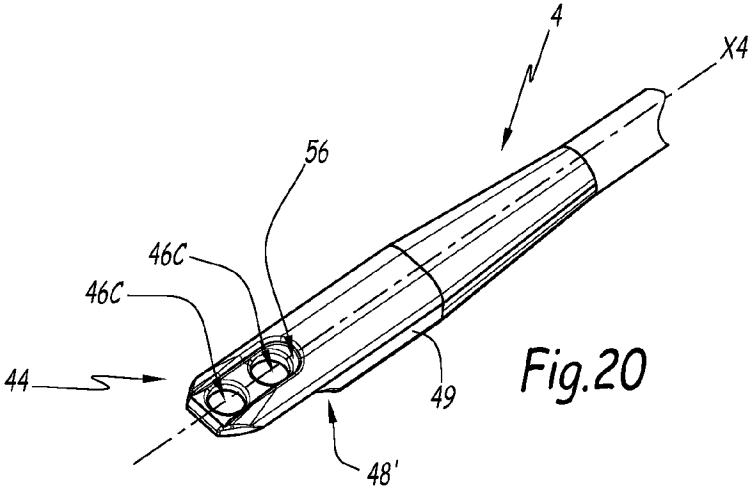

As shown more particularly in FIG. 16, the eye 1002 and the strand 1004 overlap one another by the bottom 1251 of the tab 1024 and by the final portion 1052, respectively.

Thus, the overlap between the parts 1002 and 1004 takes place on a single transverse side of each of these parts 1002 and 1004. In particular, at the longitudinal level of the cavity 1048', the part 1002 overlaps the part 1004 by a single transverse side of the part 1002.

Thus, the assembly between a tab 1024 of the eye 1002 and an end 1044 of a strand 1004 takes place in a minimal bulk and while optimizing the transitions between eye 1002 and strand 1004. Furthermore, the free end 1054 of the portion 1052 does not risk catching on yarns adjacent to the heddle 1001 because that free end 1054 is received in the niche 1029, at the two side walls forming the transitional part 1242.

During the assembly, the link 1002 and each strand 1004 overlap in the longitudinal direction X1, such that the housing 1046 is respectively positioned, along the axis X1, at the projections 1028. The housing 1046 of the strand 4 and the projections 1028 of the eye 1002 then form a pair of housings.

The assembly between the strand 1004 and the eye 1002 is done by clipping, by engagement of the eye 1002 provided with its two tabs 1024 with the two strands 1004 each provided with a receiving cavity 1048 and a distal cavity 1048'. The tab 1024 is placed above the cavity 1048, then brought closer to the bottom 1051 along the axis Z1. Since the width of the projections 1028 is greater than the width of the cavity 1048 considered outside the housing 1046, the approach action elastically deforms the side walls 1049 of the receiving cavity 1048, which separate along direction Y1, so as to allow the projections 1028 to become placed in the two notches 1049A. When the projections 1028 cooperate with the housing 1046, the walls 1049 return elastically to the initial position. The cooperation of the projections 1028 with the housing 1046 with the tab 1024 in contact with the bottom 1051 and with the bottom 1251 of the tab 1024 in contact with the final portion 1052 blocks the eye 1002 relative to the strand 1004 in both longitudinal, lateral and transverse directions as well as in rotation around the axis X1, Y1 and Z1.

FIGS. 18 to 24 show a third embodiment of a guide heddle 1 for a warp yarn for a loom of the Jacquard type. Inasmuch as this embodiment is structurally close to the first embodiment mentioned above, the elements shared by these two embodiments bear the same references. Hereinafter, we will not provide a detailed description of the elements of this third embodiment that are similar to those of the first embodiment.

The eye 2 of this embodiment differs from that of the first embodiment in that the edges 27 of the tabs 24 with reduced width have no notch 28. In other words, these edges 27 are straight. Furthermore, the central portion 20 of the eyelet 22 is provided, in each transition zone 25 and near each tab 24, with two housings 26 that are aligned along the axis X2, which cross all the way through the central portion 20 and which have a circular section.

Furthermore, the second end 44 of each strand 4 comprises a cavity 48 that is defined between two side walls 49, a bottom 51 and a ceiling 53 opposite the bottom 51 and that connects the side walls 49. In other words, compared with the cavity 48 of the first embodiment, the cavity 48 of this embodiment does not emerge opposite the bottom 51, along a transverse axis Z4 defined as in the first embodiment.

Furthermore, a final portion 52 of the end 44 that extends the bottom 51 in the direction of the longitudinal axis X4 of the strand 4, i.e., in the direction of the longitudinal axis X1 of the heddle in the mounted configuration thereof, toward the eyelet 22 of the eye 2, is provided with two housings 46C that cross all the way through that final portion 52 and that also have a circular section.

In the assembled configuration of the heddle 1, the cavity 48 of each end 44 receives a tab 24 of the eye 2. In that configuration, the two housings 26 arranged at one end of the central portion 20 are respectively aligned with the two housings 46C arranged in the final portion 52 of the adjacent strand 4. Two pairs of housings 35 are thus formed each made of a housing 26 and a housing 46C.

Figure 19:
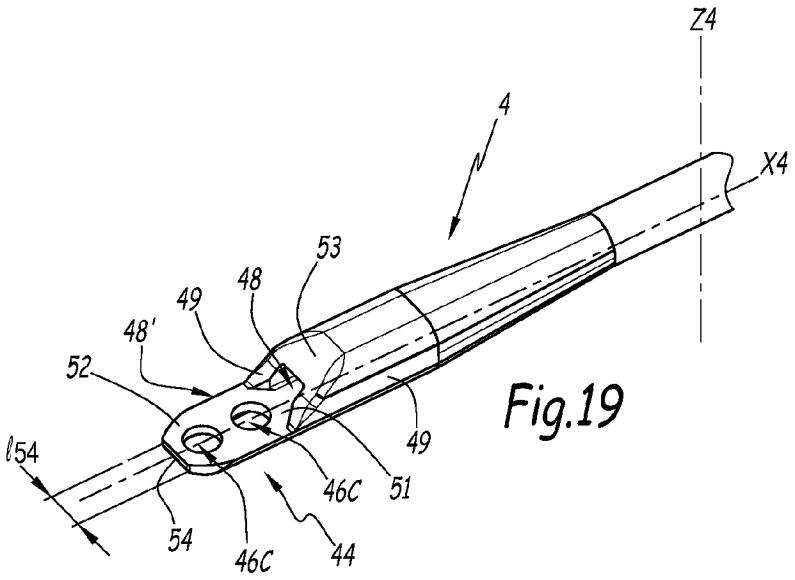
Figure 21:
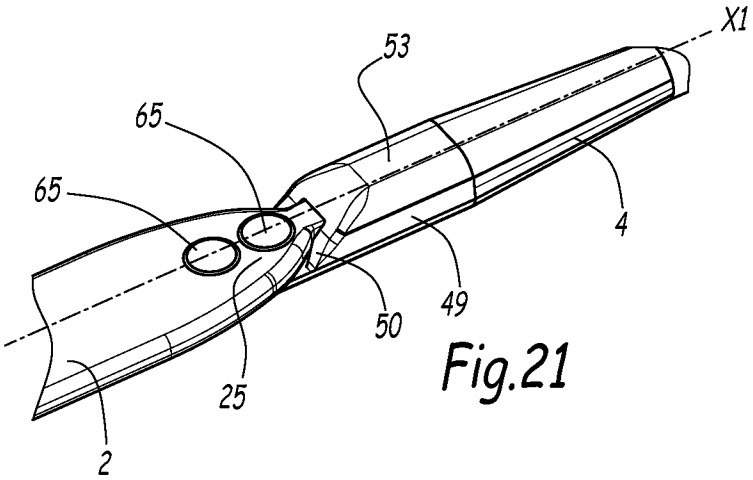

As shown more particularly by FIG. 19, the cavity 48 is arranged in a proximal part of the end 44, i.e., in a part of that end closer to the middle of the strand 4 than the final portion 52. Furthermore, a distal cavity 48' is arranged across from the final portion 52, on a single transverse side of the strand 4, the cavity being defined by the dihedron formed by the face of the final portion 52 visible in FIG. 19 and the half-plane of the beveled edges 50 of the walls 49 that join that face, on either side of the mouth of the cavity 48. The bottom of the distal cavity 48' in the direction Z1 is formed by the final portion 52. The cavity 48' has no side wall, i.e., it is not delimited by physical walls along the lateral axis Y1. This distal cavity 48' receives, in the mounted configuration of the heddle 1, the transition zone 25 of the central portion 20 of the eye 2 in which the housings 26 are arranged.

Reference p48' denotes the depth of the cavity 48' measured parallel to the transverse axis Z4 between the final portion 52 and the end of the beveled edges 50 furthest from the final portion 52. The depth p48' varies along the axis X1. Reference e25 denotes the thickness of the transition portion 25, measured parallel to the axis Z2. In the assembled configuration of the heddle 1, at a same longitudinal level along the axis X1, the depth p48' is greater than the thickness e25.

Reference l25 denotes the width of the transition portion 25 measured parallel to the lateral axis Y1 of the heddle 1. Reference l54 denotes the width of the free end 54 of the final portion 52 also measured parallel to the axis Y1. The width l54 is smaller than the width l25 at the same longitudinal level. Furthermore, the final portion 52 has a gradual reduction in width along the lateral axis Y1, toward the free end 54. The transition zone 25 of the eye 2 is positioned along the axis X1 overlapping the final portion 52 at the longitudinal level of the cavity 48'. This transition portion 25 has a gradual reduction in width along the lateral axis Y1, toward the free end 240 of the eye 2.

During manufacturing of this heddle 1, when the eye 2 provided with its two tabs 24 is engaged with the two strands 4 each provided with its receiving cavity 48 and its distal cavity 48', the pairs of housings 35 are formed, it is possible to pour an assembly member of the resin rivet type 65 into each of them. After the resin has solidified, this rivet secures the parts 2 and 4 at their overlapping ends.

Figure 22:
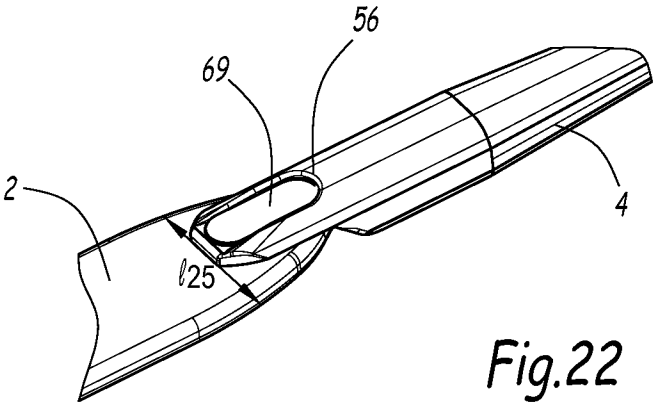
Figure 23:
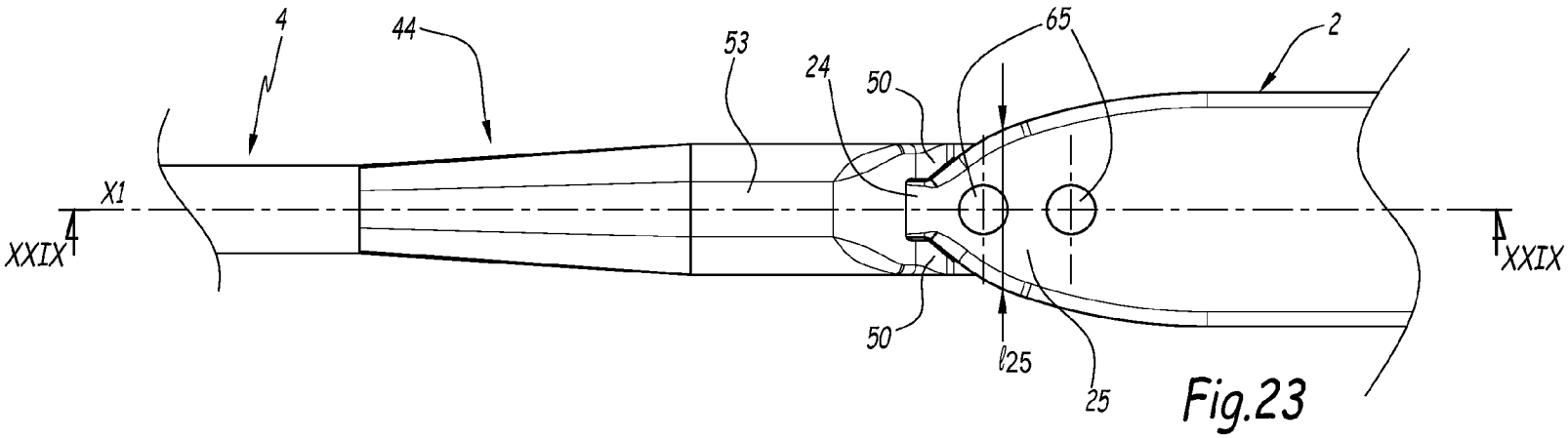

FIG. 22 shows that, on the side of the slot 56 that is arranged in the final portion 52 opposite the cavity 48, the heads of the rivets 65 are connected by a base plate 69 that substantially fills that entire slot 56.

As shown more particularly in FIG. 24, the parts 2 and 4 overlap one another by the transition zone 25 and by the final portion 52. Thus, the overlap between the parts 2 and 4 takes place on a single transverse side of each of these parts. In particular, at the longitudinal level of the cavity 48', i.e., along the longitudinal axis X4, the part 2 overlaps the part 4 by a single transverse side of the part 2. Thus, in the zone where the rivets 65 are formed, it is possible to access each of those parts 2 and 4 by a transverse side.

According to one advantageous aspect of the invention that is not shown, the ceiling 53 can be pierced with an opening providing access to the inside of the cavity 48, near the closed end 484 of that cavity, i.e., its end opposite its mouth. This in particular makes it possible to view the tab 24 of the eye in place in the proximal cavity 48.

According to a first alternative of this third embodiment that is not shown, the cavity 48 is removed in each strand 4, as well as the tab 24 at each end of the central portion 20. In that case, the overlap between the parts 2 and 4 takes place only at the final portion 52, by engaging the transition zone 25 of the end of the central portion 20 in the cavity 48', with an overlap of a single transverse side of each of the parts 2 and 4.

According to another alternative that is also not shown of this third embodiment, the pairs of housings comparable to the pairs of housings 31 to 34 of the first embodiment can extend to the closed cavity 48. In that case, housings with an appropriate shape are provided in the tabs 24 as well as in the bottom 51 and/or in the ceiling 53 and/or in the side walls 49. The housings of the tabs 24 can be notches, as in the first embodiment, or through housings with a circular section, like the housings 26 of the third embodiment.

Within the meaning of the present invention, two housings are across from one another if they are at least partially facing one another and communicate with one another before the deposition of the resin. In particular, when two housings are across from one another in a given direction, the projections of the outlets of the housings of the pair of housings turned toward the other housing of the pair of housings in a plane perpendicular to the facing direction at least partially overlap.

The overlap of the eye 2 and the strand 4 on a single transverse side makes it possible to produce an eye/strand junction in a minimal transverse bulk. Indeed, the first part does not extend on both sides of the second part in the transverse direction. The eye/strand junction is produced with minimal eye/strand interfaces that are optimized to limit the fragility of adjacent yarns by rubbing against the heddle. These two parts, i.e., the strand and the eye, both remain accessible during the assembly operation, which makes it possible to inspect the assembly. Furthermore, the use of a cavity emerging perpendicular to the main plane of the eye makes it possible to limit the bulk of the composite heddle in the loom, and therefore the impact of the heddle on the yarn density of the loom.

According to alternatives of the invention not shown in the figures:

a receiving cavity is arranged only in the eye 2;

the depth p48 of the receiving cavity 48 is smaller than the thickness e24 of the tab 24;

the width l48 of the cavity 48 is smaller than the width l24 of the tab 24;

the assembly between the strand 4 and the eye 2 is done by gluing or welding of the strand 4 and the eye 4 engaged with one another or by deformation of one of two parts 2 and 4 in the other or by plastic crushing of one of the two parts 2 and 4 around the other after the engagement of the two parts with one another or by screwing of one of the two parts 2 and 4 in the other;

the strand(s) of the heddle body may be made from a plastic material or steel. The eye can be made from steel, ceramic or plastic;

as an alternative to the first embodiment, the cavity can be provided with a single lateral edge.

Figure 25:
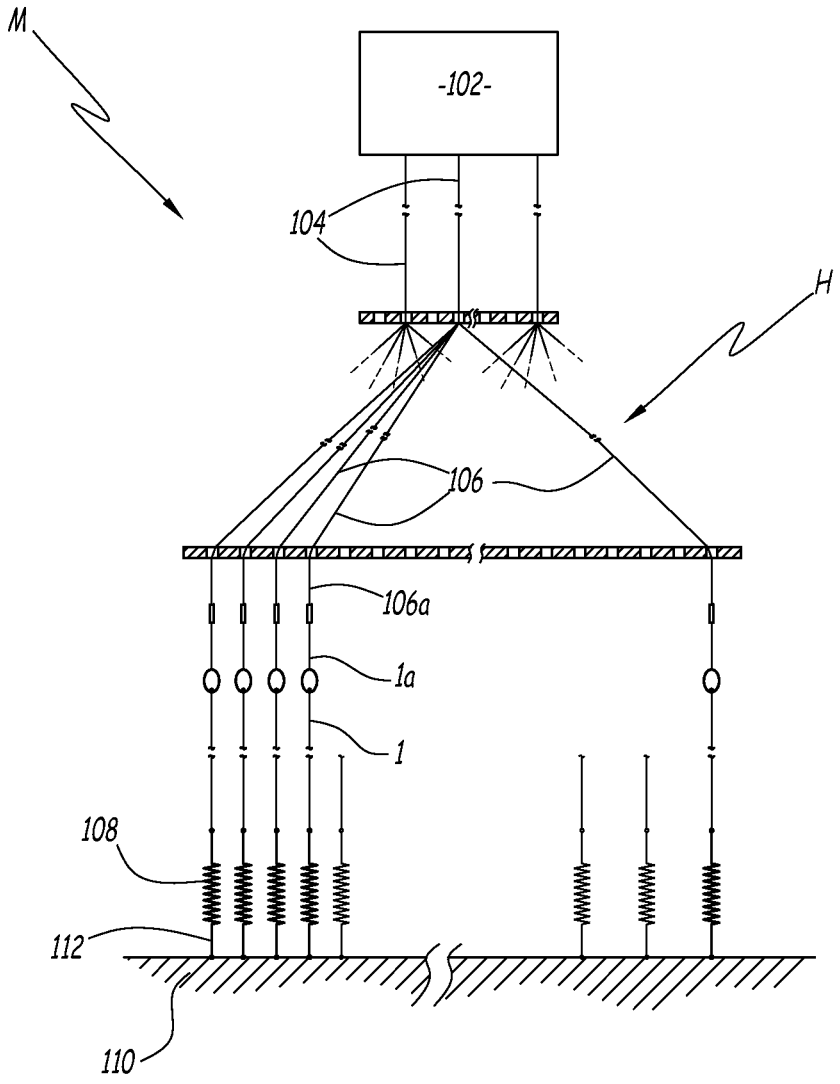
FIG. 25 is a diagrammatic illustration of a loom of the Jacquard type, according to the invention and incorporating one of the heddles shown in FIGS. 1 to 24.

The loom M is shown in FIG. 25 with heddles 1 according to the first embodiment. It can also be equipped with heddles 1001, 2001 and 1 of the other embodiments.

The invention is described above as it applies on a Jacquard-type loom. It is, however, applicable to heddles for frames or frame looms.

The embodiments and alternatives considered above may be combined with one another to create new embodiments.

The invention claimed is:

1. A heddle for guiding a warp yarn for a loom, the heddle extending lengthwise along a longitudinal axis and being formed by the assembly comprising:

a heddle body including at least one strand, and an eye including an eyelet for passage of the warp yarn and defining a main plane, wherein a first part among the strand and the eye is provided, before assembly, with an end part, the second part among the strand and the eye is provided, before assembly, with a receiving cavity for receiving the end part arranged at a longitudinal end of the second part, the receiving cavity is provided with a bottom and emerges on an outside of the second part, along a transverse axis perpendicular to the main plane, and wherein, at the longitudinal level of the receiving cavity, the first part overlaps the second part by a single transverse side of the first part.

2. The guide heddle according to claim 1, wherein, at a same level along the longitudinal axis, a depth of the receiving cavity is greater than or equal to a thickness of the part received in the receiving cavity, the depth and the thickness being measured parallel to the transverse axis.

3. The guide heddle according to claim 1, wherein the receiving cavity is delimited, along an axis that is perpendicular to the longitudinal and transverse axes, by at least one side wall, wherein each side wall has a rounded outer longitudinal edge and wherein the at least one side wall is beveled toward a free end of the second part.

4. The guide heddle according to claim 1, wherein the receiving cavity has no side wall, as the receiving cavity is not delimited by physical walls along a lateral axis that is perpendicular to the longitudinal and transverse axes, and the bottom of the receiving cavity is formed by a final portion with a free end of the second part.

5. The guide heddle according to claim 4, wherein the receiving cavity is delimited along the longitudinal axis by a beveled part toward the bottom of the receiving cavity.

6. The guide heddle according to claim 4, wherein the longitudinal end of the second part includes another cavity, which extends the receiving cavity with no side wall, and in which a portion of the first part is received, the another cavity being defined by at least one side wall and a bottom along the transverse axis.

7. The guide heddle according to claim 6, wherein the another cavity is defined by two side walls, a bottom and a ceiling.

8. The guide heddle according to claim 4, wherein the receiving cavity has a gradual reduction in width along a lateral axis, and wherein a width of the free end of the part within the receiving cavity is smaller than the width of the part received in the receiving cavity at the same longitudinal level, those widths being measured parallel to the lateral axis.

9. The heddle according to claim 8, wherein the first part has a transition zone with a gradual reduction in width along the lateral axis positioned at the longitudinal level of the cavity.

10. The guide heddle according to claim 1, wherein the second part on which the cavity is formed is made from a plastic material.

11. The guide heddle according to claim 10, wherein the second part on which the cavity is formed is made from an injected plastic material.

12. The guide heddle according to claim 1, wherein the heddle includes an eye and two strands, each strand being provided, at one end, with at least one cavity for receiving a longitudinal end of the eye, and at the other end, connecting means for connecting to an element of a Jacquard harness of the loom or a heald frame.

13. The guide heddle according to claim 1, wherein at least one housing arranged on the bottom of the receiving cavity is positioned across from a housing arranged on the part of the first part to form a pair of housings, and wherein a resin assembly member extends through the pair of housings in a direction transverse to the longitudinal axis to ensure assembly between the body and the eye.

14. The guide heddle according to claim 1, wherein an assembly between the body and the eye is done by clipping, gluing, welding, plastic crushing, screwing and/or riveting.

15. A loom equipped with several guide heddles for a warp yarn, wherein at least one heddle is according to claim 1.

* * * * *